US008016153B2

(12) United States Patent
Boenig et al.

(10) Patent No.: US 8,016,153 B2
(45) Date of Patent: Sep. 13, 2011

(54) METHOD AND APPARATUS FOR ATTACHING A LID TO AN INSULATED CONTAINER

(75) Inventors: James Michael Boenig, Sequin, TX (US); Timothy M. Holub, Cheney, KS (US)

(73) Assignee: The Coleman Company, Inc., Wichita, KS (US)

( * ) Notice: Subject to any disclaimer, the term of this patent is extended or adjusted under 35 U.S.C. 154(b) by 1422 days.

(21) Appl. No.: 11/209,963

(22) Filed: Aug. 22, 2005

(65) Prior Publication Data

US 2007/0039973 A1 Feb. 22, 2007

(51) Int. Cl.

| | |
|---|---|
| ***B65D 43/14*** | (2006.01) |
| ***B65D 51/04*** | (2006.01) |
| ***B65D 6/28*** | (2006.01) |
| ***F25D 23/00*** | (2006.01) |

(52) U.S. Cl. ..... 220/847; 220/845; 220/592.01; 220/592.03; 220/4.22

(58) Field of Classification Search ..... 411/349, 411/533; 16/225, 372, 404, 223; 220/845, 220/847, 324, 592.03, 592.09, 592.1
See application file for complete search history.

(56) References Cited

U.S. PATENT DOCUMENTS

| | | | | |
|---|---|---|---|---|
| 3,202,310 | A * | 8/1965 | Tibbets | 220/212 |
| 4,527,821 | A * | 7/1985 | Tanaka | 292/19 |
| 5,064,088 | A | 11/1991 | Steffes | |
| 5,337,911 | A | 8/1994 | Holub | |
| 5,381,920 | A | 1/1995 | Lin | |
| 5,535,883 | A * | 7/1996 | Henderson | 206/427 |
| 5,607,271 | A * | 3/1997 | Salice | 411/349 |
| 5,676,487 | A | 10/1997 | Lautenschlager | |
| 5,711,054 | A | 1/1998 | Salice | |
| 6,244,458 | B1 * | 6/2001 | Frysinger et al. | 220/592.09 |

FOREIGN PATENT DOCUMENTS

| | | | |
|---|---|---|---|
| DE | 2507994 | A1 | 8/1976 |
| GB | 1381965 | A | 1/1975 |
| WO | 02064445 | A | 8/2002 |

OTHER PUBLICATIONS

International Search Report mailed Jul. 13, 2007 from counterpart application PCT/US2006/032628.

* cited by examiner

*Primary Examiner* — Robin Hylton
(74) *Attorney, Agent, or Firm* — Kelly S. Elsea

(57) ABSTRACT

A connecting device for attaching a lid to an insulated container. The connecting device has a barb arranged and configured to be inserted into a socket and to engage the walls of the socket upon rotation. The barb may engage the walls of the socket by displacing material or engaging receptors, such as threads, in the socket. The geometry of the barb is such that, after rotation, the barb remains connected to the body and lid without the aid of screws, rivets, or other means. The connecting device may also have a sliding or other connector for connecting the connecting device to the lid. The connector may be in the shape of a dovetail and the lid may have a recess configured to receive the dovetail.

4 Claims, 10 Drawing Sheets

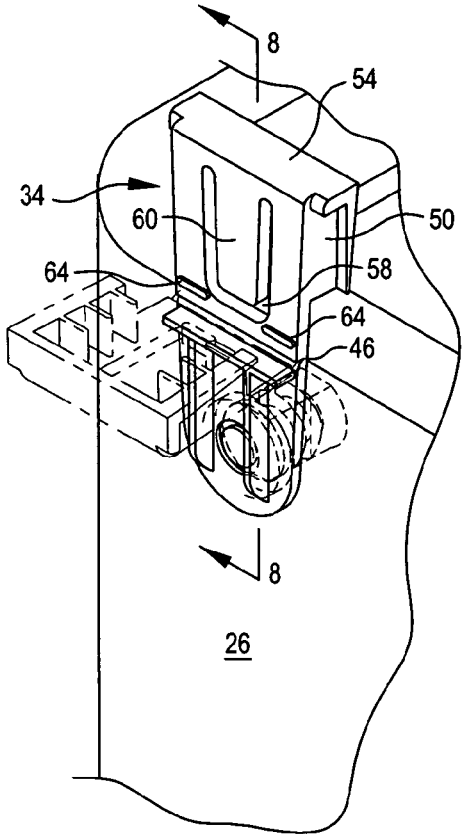
FIG. 7
FIG. 8
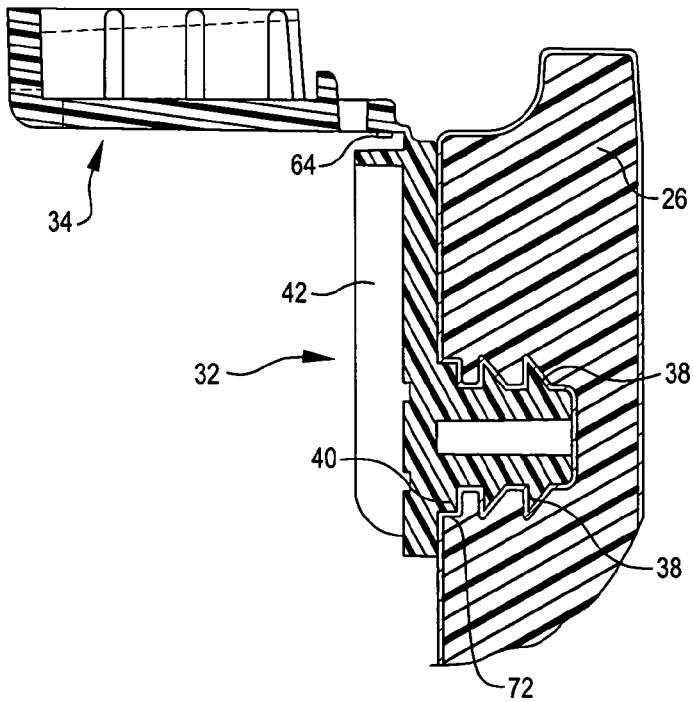

METHOD AND APPARATUS FOR ATTACHING A LID TO AN INSULATED CONTAINER

TECHNICAL FIELD OF THE INVENTION

The present invention relates to insulated containers, and more specifically relates to attaching a lid to an insulated container.

BACKGROUND OF THE INVENTION

Insulated containers, also called "coolers," are prevalent in contemporary life. Insulated containers are often used for picnics or for outdoor activities such as camping or sporting events. In addition, insulated containers are becoming more prevalent in the medical industry, where they are used to move transplant organs and other articles that need to remain cold during transport. Also, the need to transport commercial goods such as perishable food, drink, medicine, and environmental samples is becoming more important.

Some insulated containers have lids that are attached with various devices, such as hinges. One downside to current insulated containers having attached lids is that considerable labor is required to properly attach a lid to the main body of an insulated container. Often manufacturing such containers requires assembling various parts that need to be properly aligned and fitted together. For example, lids are often attached to coolers using screws that attach hinges to the cooler's main body and lid. Metal plates may be used inside the cooler's main body and lid in order to add strength to the connection between the cooler's body and lid. Considerable manufacturing tolerances must be maintained to ensure that the holes of the hinges properly align with the holes of the plate and that, once the hinges are attached, the complete assembly fits together properly.

Therefore, manufacturing coolers can involve significant amounts of labor and materials, which is expensive. Moreover, because assembled insulated containers are often too large to ship economically, labor for an insulated container may not be performed at more cost efficient labor areas, such as overseas.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, an insulated container has a body, a lid, and one or more connecting devices connecting the lid to the body. The connecting devices are configured to be inserted into a socket in the body and a recess in the lid. In accordance with an embodiment, a connecting device may be connected to the lid and the body without the aid of tools and/or by using a single hand. The geometries of the body, lid, and connecting devices are such that, once inserted, the connecting devices remain connected to the body and lid without the aid of screws, rivets, or other fasteners.

In accordance with an embodiment, a connecting device has a rotating connector, such as a barb, and a sliding or other type of connector, such as a tab with a catch. The barb is configured with teeth such that the barb may be inserted into a socket, and rotating the barb causes the teeth to engage the walls of the socket, trapping material behind the barb, and causing the barb to become anchored in the socket. The sliding connecter is configured with a locking catch such that the tab may be inserted into a recess made for the sliding connecter and the locking catch slides behind and engages an edge of the recess or another protrusion and holds the sliding connecter in place in the recess.

In accordance with an embodiment, a method for assembling an insulated container utilizes a connecting device as described above. The barb is inserted into the body of the insulated container and rotated, causing the teeth to engage. The sliding connecter is inserted into a recess in the lid made for the sliding connecter until a locking catch engages, causing the sliding connector to remain in place.

In accordance with an embodiment, an insulated container includes a handle that is rotatingly fitted onto one or more knobs. For each knob, the handle has one or more openings, tabs, and/or shoulders. Each knob is attached to the body of the insulated container, and includes a ridge. The handle is configured such that a first side of the opening on the handle fits around the knob, with the shoulder being located on this first side of the opening and fitting in the ridge of the knob. A tab is located on the handle on another side of the opening. The opening of the handle is secured from removal from the knob by the tab engaging an opposite side of the knob, thus maintaining contact of the ridge and the shoulder.

A similar opening with a shoulder and a tab is located on the opposite side of the handle, and snaps onto a knob on the opposite side of the base. The two tabs are held in position against the knobs by the configuration of the handle.

In accordance with an embodiment, a method for assembling an insulated container includes attaching the above handle to at least one knob. For each knob and opening, the shoulder is placed behind the ridge of the knob. The tabs are brought to a position abutting the edge of the knob.

Other features of the invention will become apparent from the following detailed description when taken in conjunction with the drawings, in which:

BRIEF DESCRIPTION OF THE DRAWINGS

FIG. 7 is a partial side perspective view of the connecting device and body of FIG. 1, with the connecting device rotated ninety degrees from the position in FIG. 6;

FIG. 8 is a sectional view taken generally along the section lines 8-8 of FIG. 7, with the connecting device rotated outward and ready to receive a lid;

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
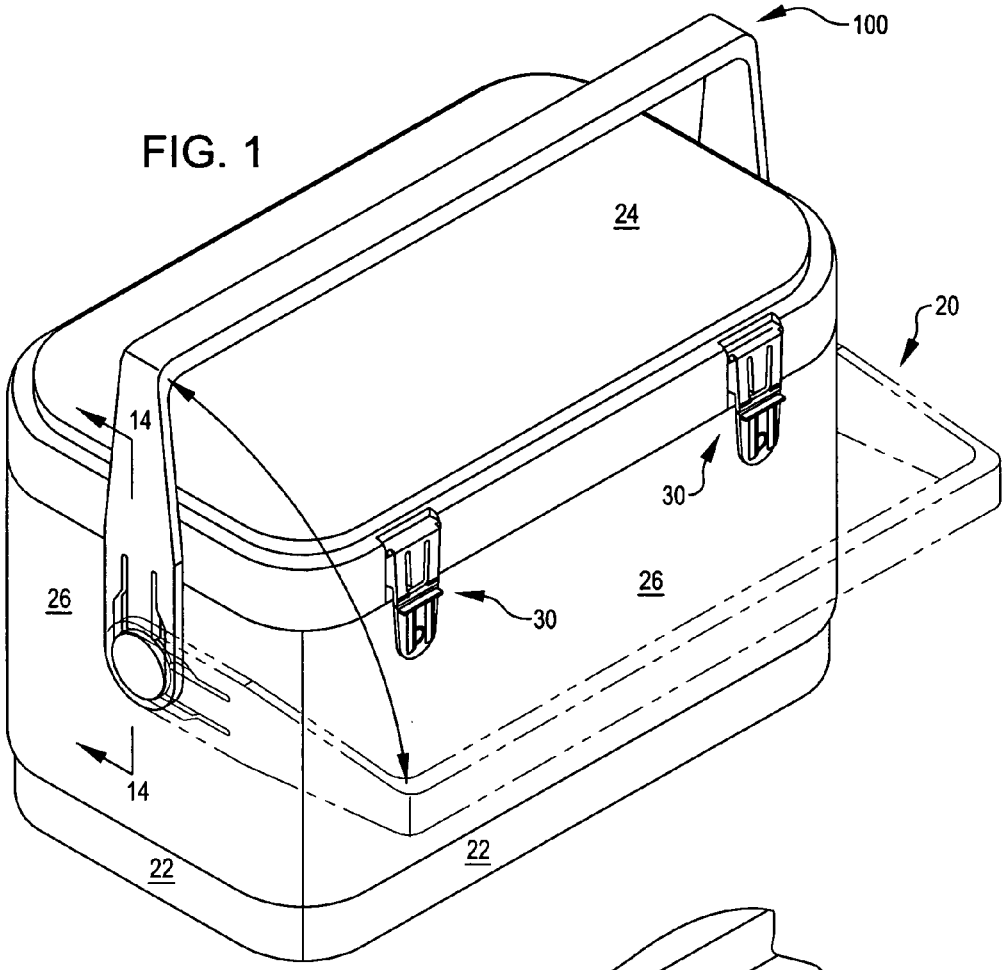
FIG. 1 is a side perspective view of an insulated container incorporating an embodiment of the present invention.

Referring now to the drawings, in which like reference numerals represent like parts throughout the several views, FIG. 1 shows an insulated container 20 incorporating an embodiment of the present invention. The insulated container 20 includes a top 24, sides 26, and a base 22 (not fully shown in the drawing). The sides 26 and base 22 are collectively referred to herein as the "main body," or "body," of the insulated container 20.

The insulated container 20 shown in the drawings is shaped like a conventional six-pack cooler, but other sizes or configurations may be used, such as an upright conventional refrigerator type of configuration, or a unit configured to operate in both chest and upright positions. The insulated container 20 may, but does not necessarily need to, include insulation. If used, insulation may be formed, for example, of polyurethane, polystyrene, polypropylene, acrylonitrile butadiene styrene (ABS), polyethylene, vacuum panels, or other suitable insulating materials or combinations of materials. Insulation preferably has sufficient thermal insulating qualities so that an insignificant amount of heat is lost through the sides 26 and top 24 of the insulated container 20.

The top 24 in the embodiment shown serves as a lid and is preferably well-fitted, and may be sealed with a friction fit or a lid seal and a latch, such as is known in the art, or with a suitable magnetic lid gasket. Such a structure minimizes heat loss that otherwise might occur through the closure for the lid.

Briefly, in accordance with an embodiment, one or more connecting devices 30 (two are used in the embodiments shown in the drawings) are provided to connect the top 24 to the body of the insulated container 20. The connectors 30 are also configured for a hinging action, so that the top 24 may be opened from the side opposite the connectors 30. One or more similar connectors may be used to connect a lid positioned at another location on an insulated container, such as when used as a side door.

Although shown for use in attaching the top 24 to the body of the insulated container 20 the drawings, features of the connector 30 may be used to connect other items to an insulated container, or two or more parts in any article. For example, a modified connector 30 may be used to connect an insulated container with a wheel assembly. In such an embodiment, it is not necessary for the connector 30 to hinge or bend, and the connector may be altered accordingly.

In accordance with an embodiment, a connecting device 30 included a lower portion 32 and an upper portion 34. In this context, "upper" and "lower" are used for ease of description, and the cited orientations are not meant to be limiting. In the embodiment shown, the connecting device includes a hinge portion 46 that permits rotation of the upper portion 34 relative to the lower portion 32. In an embodiment, the hinge portion 46 is a flexible plastic hinge, although other hinge structures may be used.

In the embodiment shown, the lower portion 32 includes a barb 36 having one or more teeth 38 and a protrusion 40. In the embodiment shown in the drawings, the teeth 38 are positioned on opposite sides of the barb 36, and extend approximately one fourth of the diameter of the barb 36, although other arrangements may be provided. The teeth 38 may each terminate in a point, or alternatively may have a flattened end so as to prevent deflection of the end. As an example, a flattened end of 0.020 inches may be provided.

The lower portion 32 may also include structural reinforcements to add rigidity, such as one or more vertical reinforcements 42 and one or more horizontal reinforcements 44. Although the barb 36 in the shown embodiment is attached to the lower portion 32 of the connecting devices 30, the barb may alternatively be attached to the upper portion, or similar or different barbs may be attached to the upper and lower portions.

The upper portion 34 may have side walls 50, side extensions 52, and an upper top wall 54. The side extensions extend out of the sides of the upper portion 34, and along a portion of the length of the upper portion 34. The upper portion 34 may be in the shape of a dovetail (as shown in the drawings) but may also have other shapes. For example, the upper portion 34 may be substantially rectangular or it may have rounded faces or edges.

The side walls 50 may have reinforcing devices to add stiffness, such as ribs 56. Other reinforcements may be provided as desired.

In the shown embodiment, the upper portion 34 includes a U-shaped cutout 58 (FIG. 4) defining a tab 60. The tab 60 shown in the drawing includes a catch 62 (FIG. 3) at its distal end and extending at a right angle to the tab 60, although the angle may be different. The upper portion 34 may have one or more pads 64. The pads 64 are positioned to engage the horizontal reinforcement 44 on the lower portion 32 so as to limit the rotational motion between the lower portion 32 and the upper portion.

Figure 3:
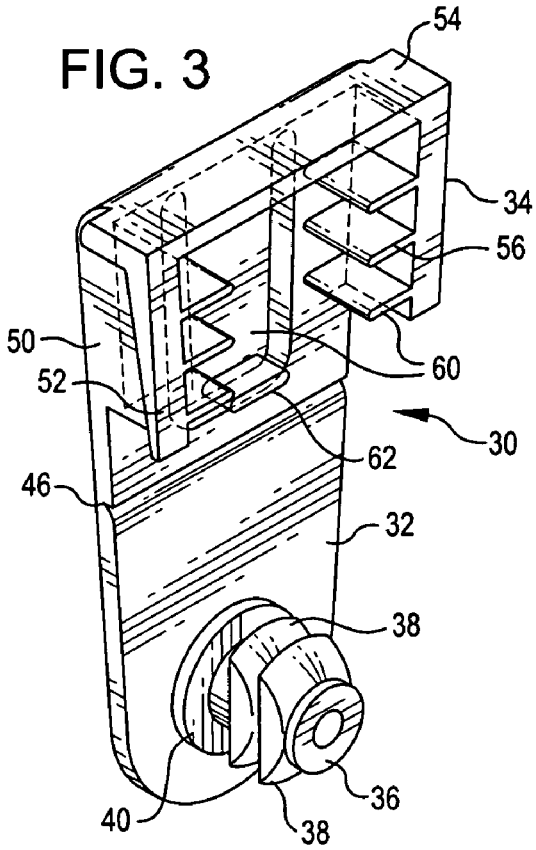
FIG. 3 is a side perspective view of the connecting device of FIG. 1.
Figure 4:
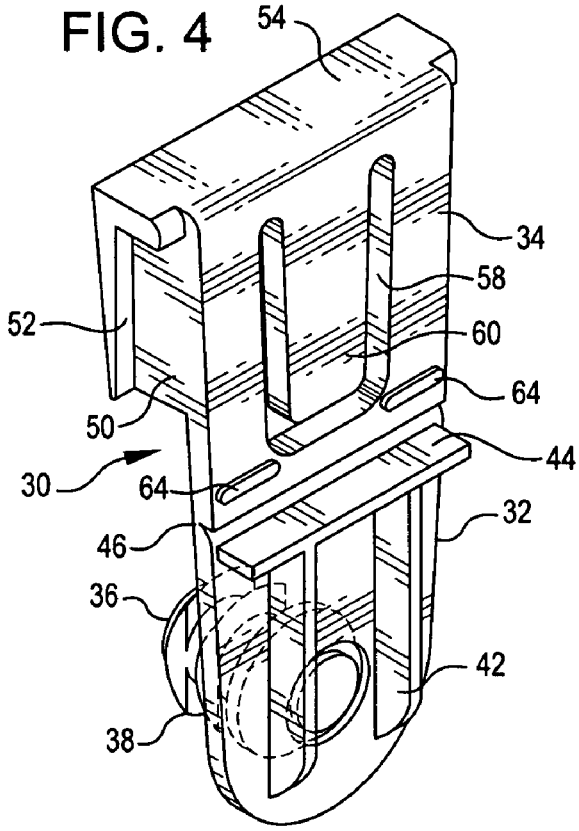
FIG. 4 is a side perspective view of an opposite side of the connecting device of FIG. 3.

The connecting device 30 may be formed from a variety of materials such as polypropylene or other plastics, metal, or other substances or combinations of substances. FIG. 3 and FIG. 4 and other drawings show connecting devices formed as one, integral piece; however, connecting devices may be formed from two or more pieces as well. For example, a lower portion and an upper portion can be formed separately and joined together by a third piece, such as a hinge, that is secured to the lower portion and upper portion by means of screws, rivets, glue, or other suitable devices. An upper portion and a lower portion may also have geometries such that they may be joined together without a third piece.

In an embodiment, the lower portion 32, the hinge portion 46, and the upper portion 34 are all made of the same plastic, with the plastic being thinner at the hinge portion to provide a hinging function. The lower portion 32 and the upper portion 34 may be thicker and/or may be reinforced as described above to maintain stiffness.

As described above, the hinge portion 46 may be made from the same material as the other parts of the connecting device 30. The hinge portion 46 may also be made from other materials, such as metal or rubber. The drawings show a hinge portion 46 being less thick relative to the adjacent parts of the lower and upper portion. This allows the lower portion 32 and the upper portion 34 to rotate relative to one another. However, if the hinge portion is sufficiently flexible, it is not necessary that the hinge portion be less thick than the adjacent parts.

If desired, in an embodiment, the lower portion 32 may be rigidly affixed to the upper portion 34, and the upper and lower portions may be fixed in a desired orientation relative to one another, such as within the same plane or at right angles relative to one another. As such, the transition between the upper portion 34 and the lower portion 32 may not be well defined, or may not be defined at all. In any event, whether hinging function is provided or not, the upper portion 34 and a lower portion 32 serve as a base for the connectors described herein.

In accordance with an embodiment, one or more sockets 70 (FIG. 5) are provided, for example, on the insulated container 20. The sockets 70 are shown in one of the sides 26 of the insulated container 20, but may otherwise be situated. In addition, the number of sockets is not necessarily limited to two, as shown in FIG. 1. For example, there may be one or more sockets 70 in the top of the container, or in both the top and one or more sides of the container. The sockets 70 may be placed in various places on a container appropriate to their use, for example for attaching accessories to the container such as wheels, wheel assemblies, or handles The sockets 70 shown in the drawing include a shelf 72, an upper wall 74, a lower wall 76, and side walls 78. The upper wall 74 and lower wall 76 are flat, and the side walls 78 are rounded or curved. In an embodiment, the arc of curvature of the side walls 78 has a focus of the center of the socket 70.

The sockets 70 may be formed in a variety of ways. For example, the socket may be molded into one or more sides of the insulated container 20. Sockets may also be formed by boring or drilling. In general, any method for creating a recess in an object may be utilized.

In general, as further described below, the sockets 70 are configured to receive and anchor the barbs 38 on the connector 30. The drawings show sockets 70 having a particular geometry, but other geometries may be used. For example, the walls of a socket may have receptors, such as threads or grooves, behind which teeth from a barb 38 may rest after insertion. In general, a socket may have any geometry that causes an inserted barb 38 to remain in a socket, for example, a combination of walls and threads, or other configurations.

Figure 9:
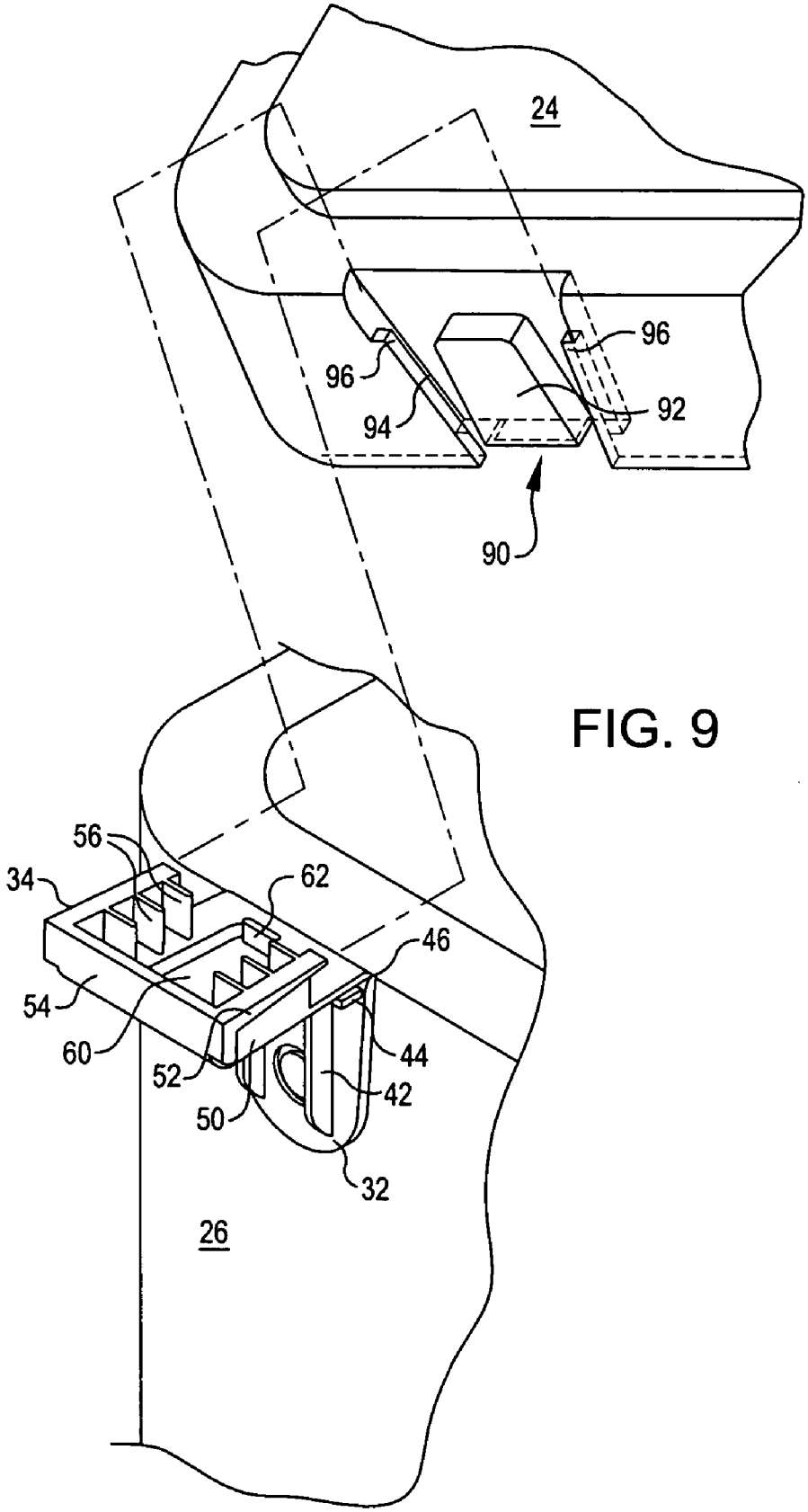
FIG. 9 is a partial side perspective view of the connecting device, body, and lid of FIG. 1, showing the lid just prior to connection to the connecting device.

Referring to FIG. 9, in accordance with an embodiment, one or more recesses 90 are provided in the top 24 of the insulated container 20. The recesses 90 are shown in the top 24 of the insulated container, but they may be otherwise situated, such as in the body. Also, the number of recesses is not necessarily limited to two as shown in FIG. 1. For example, there may be one or more recesses 90 in the top 24 of the container, or in both the top and one or more sides 26 of the container.

The recesses 90 include a protrusion 92 centrally located within each recess. Channels 94 are formed at outer edges of the recesses by inwardly-extending shoulders and the back walls of the recesses 90.

The recesses 90 may be formed by molding the necessary structures into the top 24 of the insulating container 20. Alternatively, machining or another suitable method may be used to form the channels.

Figure 5:
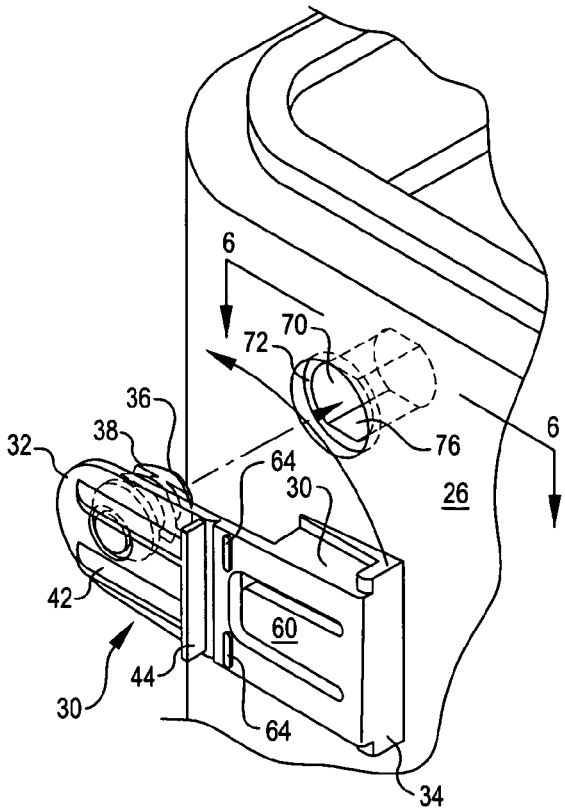
FIG. 5 is a partial side perspective view of the connecting device of FIG. 1, showing a way the connecting device may be inserted into a body of the insulated container.
Figure 6:
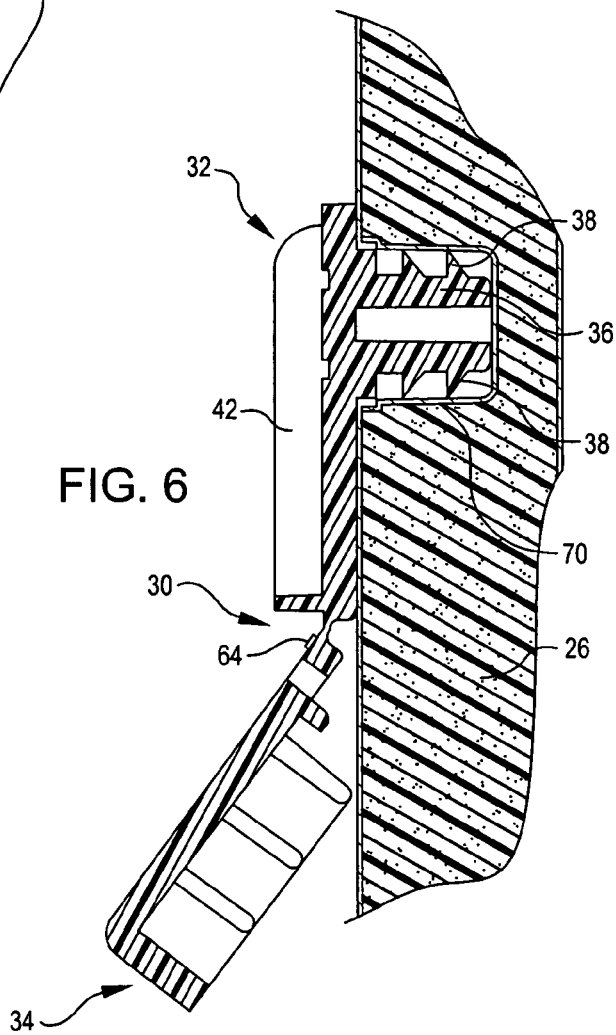
FIG. 6 is a sectional view taken generally along the section lines 6-6 of FIG. 5, with the connecting device at an initial stage of insertion into the body of the insulated container.

In reference to FIG. 1 through FIG. 12, an insulated container 20 is shown with a lid 24 connected to a body by two connecting devices 30, each having a hinge portion 46. FIG. 5 shows a process of inserting a barb 36 into a socket 70. The connecting device 30 is oriented horizontally so that the teeth 38 of the barb 36 align with the rounded side walls 78 of the socket 70, permitting the barb 36 to be inserted into the socket 70 without the teeth 38 significantly hindering the insertion. The barb 36 is inserted until the protrusion 40 nests against shelf 72, as shown in FIG. 6. While maintaining the nested abutment of the protrusion 40 against the shelf 72, the connecting device 30 is rotated ninety degrees as indicated in the drawing, causing the teeth 38 to engage the lower wall 76 and the upper wall 74 and to become embedded in each wall as shown in FIG. 8. During rotation, the shelf 72 aligns limits movement of the protrusion 40, keeping the barb 36 centered in the socket 70 so that, after rotation, the connecting device 30 is positioned properly relative to the body and top 24 of the insulating container 20.

In the rotating process of the barb 36, the teeth 38 on the barb 36 engage the upper wall 74 and lower wall 76 of the socket 70, displacing material and anchoring the teeth 38 into the upper and lower walls, causing the barb to be secure in the socket. The protrusion 40 is nested against the shelf 72 thereby restricting the movement of the lower portion 32 of the connecting device 30 relative to the body of the insulated container.

The drawings show barbs 36 having teeth 38 that displace socket wall material when the barb is fully inserted. Such a configuration provides a strong connection which is desirable in consumer products such as insulated containers. However, there are other suitable configurations that may be utilized. For example, instead of teeth, a barb may have threads or discontinuous threads instead of teeth. Threads may guide a barb into a socket as the connecting device is rotated. In addition, it is not necessary that teeth or threads displace material in the wall of the socket. As described above, the geometries of the socket and barb may be such that, once a barb is fully inserted into a socket, the geometries cause the barb to remain in the socket. For example, a socket may have receptors, such as threads or grooves, for receiving threads or teeth on a barb, or threads on a barb may displace material in a socket wall.

Figure 10:
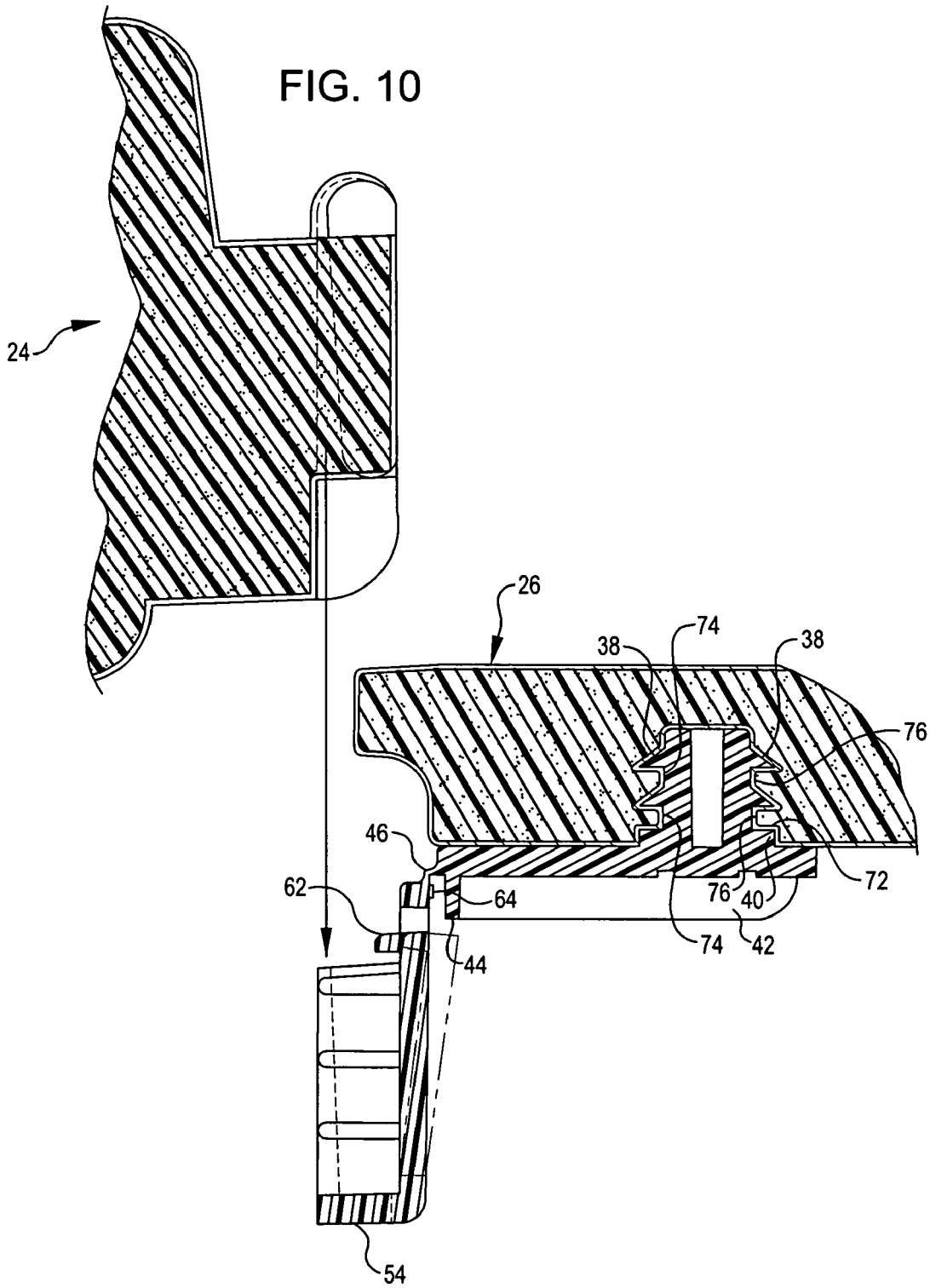
FIG. 10 is a partial side cut-away view of the connecting device, body, and lid of FIG. 1, showing the lid aligned for connection to the connecting device.
Figure 11:
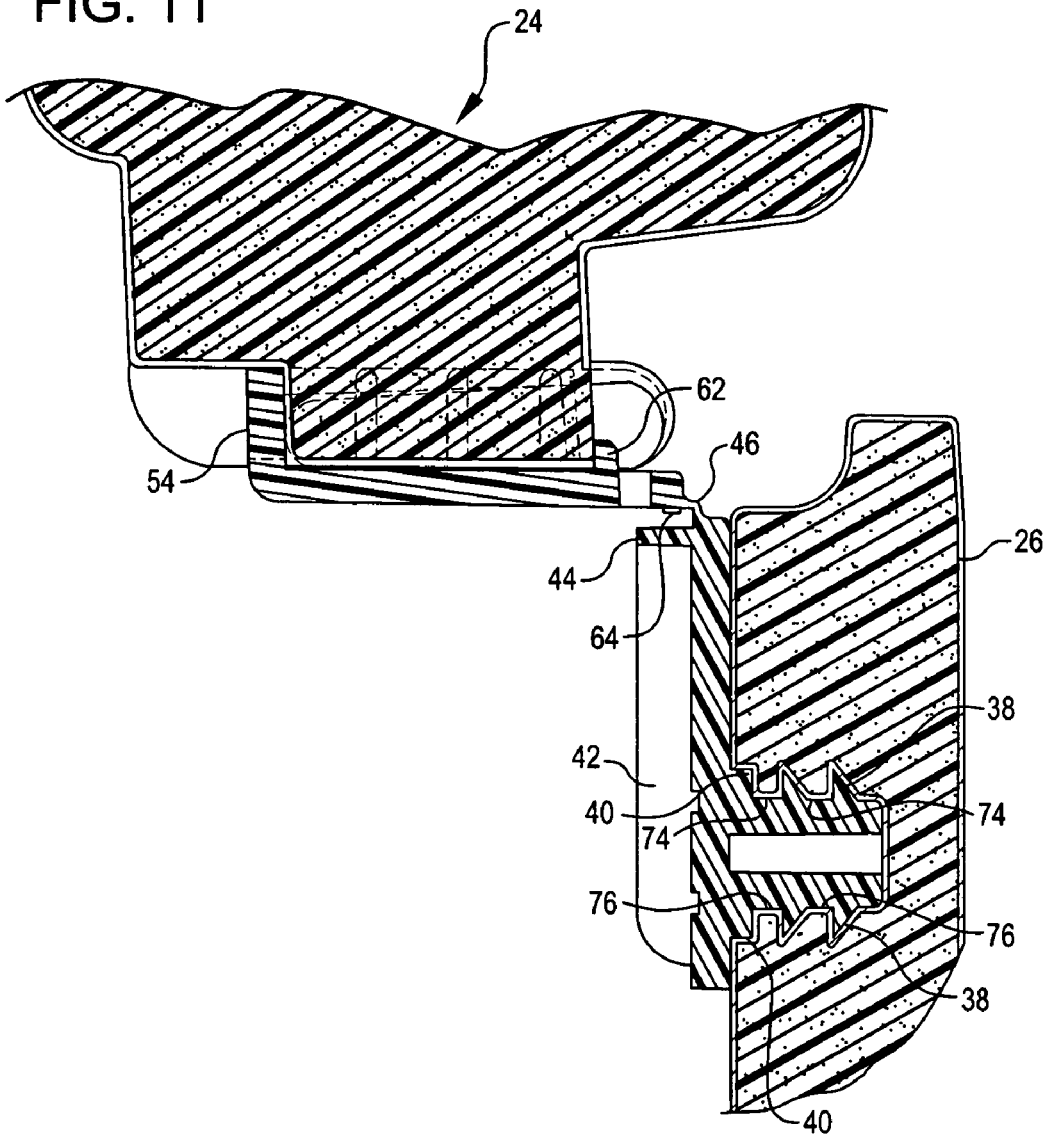
FIG. 11 is a side partial cut-away view of the connecting device, body, and lid of FIG. 1 as they are assembled together, with the lid in a fully opened position relative to the body.
Figure 12:
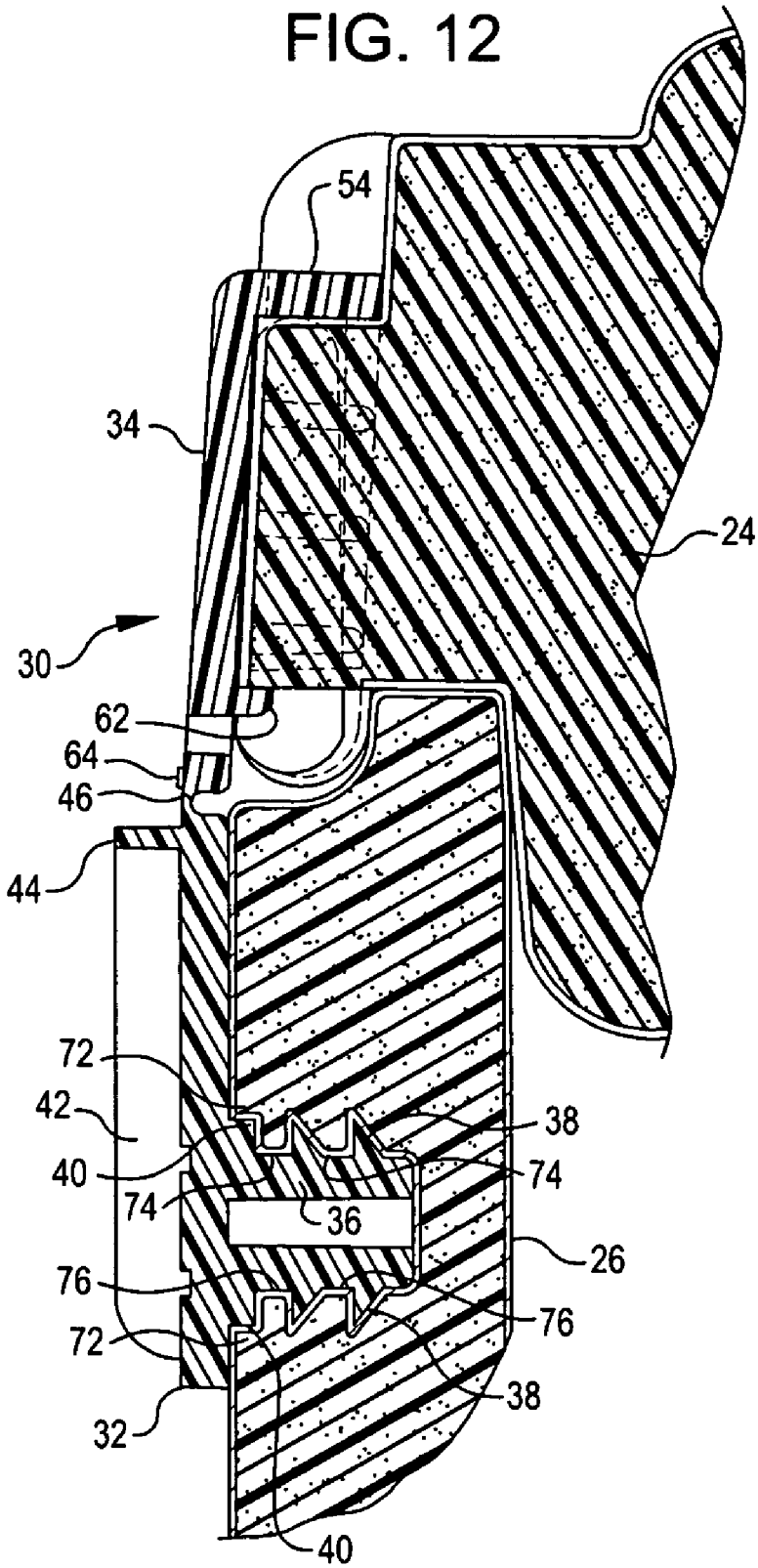
FIG. 12 is a partial side cut-away view of the connecting device, body, and lid of FIG. 1, with the lid rotated to a closed position.
Figure 13:
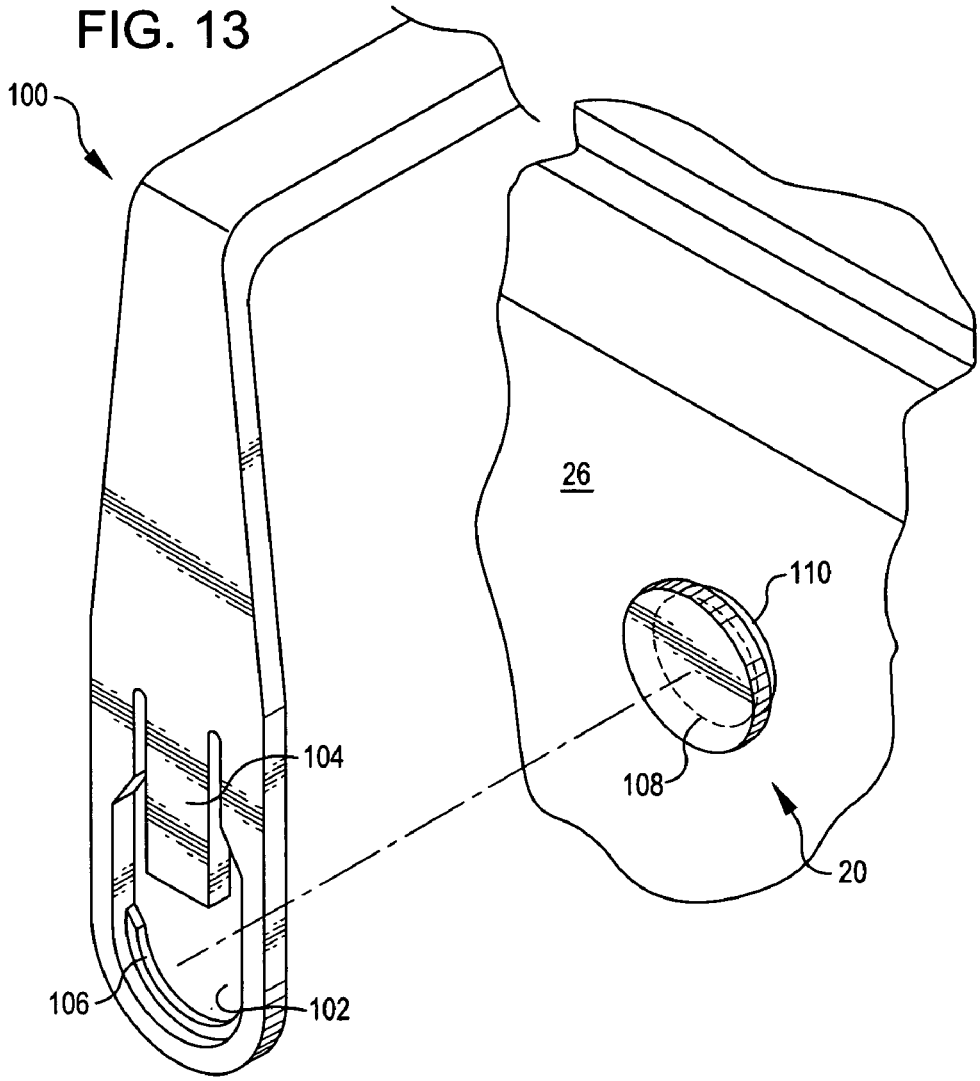
FIG. 13 is a partial side perspective view showing a handle just prior to installation on a knob on an insulated container.
Figure 14:
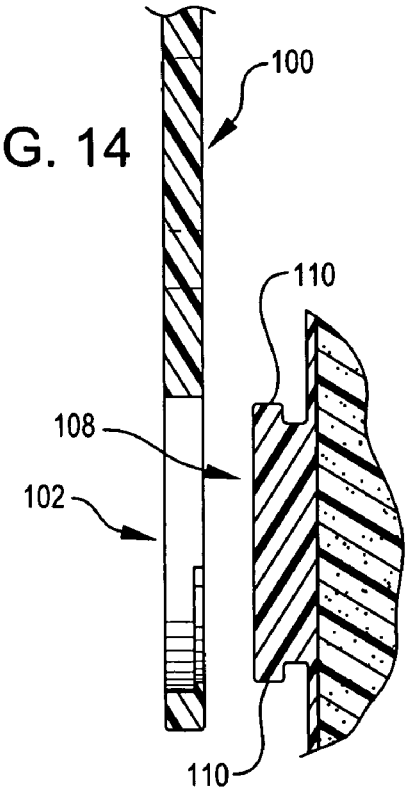
FIG. 14 is a side cut-away view of the handle and knob of FIG. 13, with the handle closer to the knob and ready for installation.

FIG. 9 shows the insertion of the upper portion 34 of the connecting device 30 into the recess 90 of the top 24. The upper portion 34 is bent back, for example ninety degrees relative to the lower portion 32, so that the body of the insulated container 20 does not interfere with insertion of the upper portion 34 into the recess 90. As shown in FIG. 9, the top 24 is then moved so that the front side extensions 52 enter the channels 94 and, as shown in FIG. 10, the upper portion 34 is inserted into the recess 90 until the catch 62 clears the bottom edge of the protrusion 92. During the insertion process, the catch 62 contacts the protrusion 92 causing the tab 60 to bend. The tab 60 springs back into place when the catch 62 clears the bottom edge of the protrusion 92. Once inserted, the ribs 56, upper top wall 54, and catch 62 are positioned around the protrusion 92, preventing the upper portion 34 from moving around the protrusion. The shoulders 96 prevent the upper portion 34 from moving away from the recess 90.

After installed, the upper portion 34 of each connecting device 30 rests inside the recess 90 in the edge of the top 24. The shoulders 96 are situated against the front side extensions 52 so as to prevent the upper portion 34 from moving away from the edge of the top 24. In each connecting device 30 shown in the drawings, the tab 60 is situated against the protrusion 92 with the catch 62 situated against the edge of the protrusion thereby preventing the upper portion 34 of the connecting device from moving in a vertical direction towards the upper edge of the top 24. Also in each connecting device, the top wall 54 is situated against the top edge of the protrusion 92 thereby preventing the upper portion 34 of the connecting device 30 from moving vertically towards the lower edge of the top 24.

Figure 2:
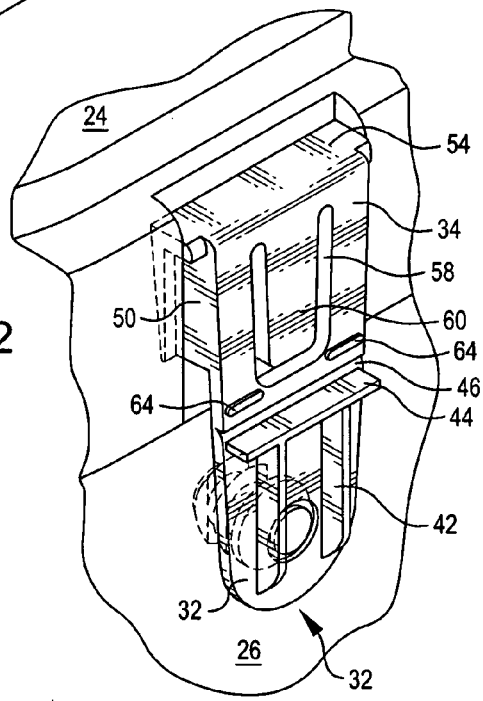
FIG. 2 is a partial side perspective view of the connecting device of FIG. 1.

As shown in FIG. 2, the dovetail shape of the upper portion 34 in combination with the geometry of the recess 90 also prevents the upper portion of the connecting device 30 from moving vertically towards the lower edge of the top 24. As shown in FIG. 7, the pads 64 and the horizontal reinforcement 44 restrict the movement of the lower portion 32 relative to the upper portion 34 by coming into contact when the lower portion and the upper portion 34 have a certain angle (ninety degrees in the drawings) between them. The vertical reinforcements 42 are oriented ninety degrees perpendicular to the horizontal reinforcement 44 in order to oppose force exerted on the horizontal reinforcement by the pads 64 when the pads and the horizontal reinforcement come into contact.

After the upper portions 34 are locked into place in the top 24, the connecting devices 30 cannot rotate. Thus, accidental disconnection of the barbs 36 with the sockets 70 is prevented.

An advantage of many embodiments of the invention is that assembly of the insulated container body to the top 24 can be performed without tools. For example, a person working in a factory may assemble an insulated container, as shown in the drawings, using only his hands. In addition, assembly is permitted with less parts, such as plates, than has been needed previously. Also, embodiments of the invention reduce the amount of material lost to scrap.

In accordance with another embodiment, a handle 100 (FIG. 1) is provided for the insulated container 20. The handle 14 shown in the drawing is U-shaped, and includes two lower portions, each having an opening 102, a tab 104, and a shoulder 106. The insulated container 20 shown in the drawings includes two knobs 108, each having a ridge 110.

In relation to the opening 102, the tab 104 is antipodal to the shoulder 106. Two opposite sides 26 of the insulated container 20 each have a knob 108 with a ridge 110.

Figure 16:
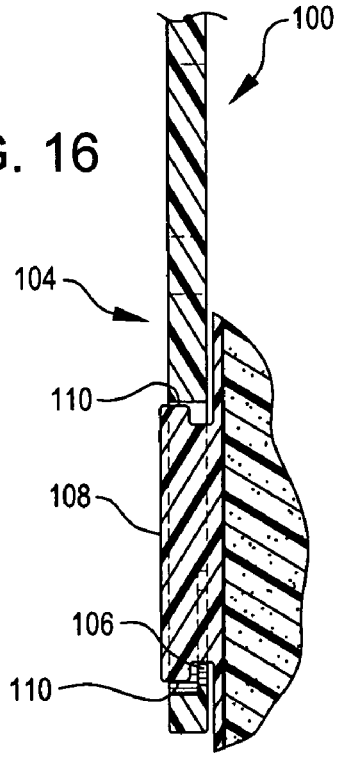
FIG. 16 is a side cut-away view of the handle and knob of FIG. 13 in an assembled configuration.

For each side of the handle 100, the opening 102 is secured to the knob 108 by the shoulder 106 and the tab 104. As shown in FIG. 16, the shoulder 106 rests in the ridge 110 and the tab 104 abuts the knob 108. Other configurations may be used. For example, the tab 104 may rest in a groove or may otherwise be locked from movement. As indicated in FIG. 1, the knobs 108 are substantially circular allowing the handle 100 to rotate around the knobs 108 to various positions.

Figure 15:
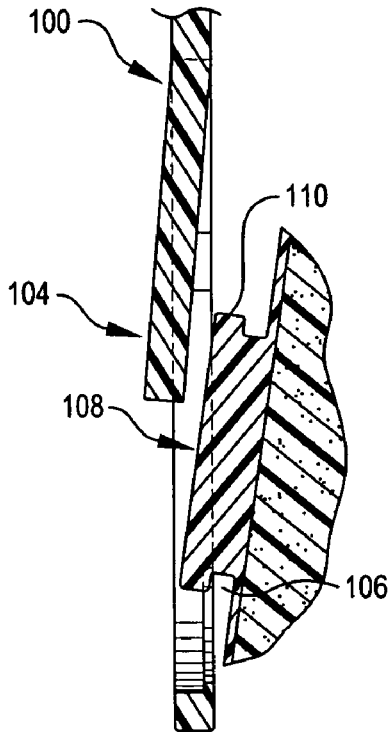
FIG. 15 is a side cut-away view of the handle and knob of FIG. 13, with the handle partially inserted into a ridge of the knob.

FIGS. 13 through 16 show a process for attaching a handle 100 to an insulated container 20. The lower portion of the handle 100 is arranged (e.g., by tilting the handle) or is bent so that the shoulder 106 is inserted on the inside of the ridge 110. The lower portion of the handle 100 is then arranged vertically, either by lifting the entire handle (moving from a tilted position) or releasing the bend formed when installing the handle, if bent. As shown in FIG. 15, the tab 60 is bent during this movement to the vertical position, and rolls over the top of the knob 108. The tab 60 is thus brought into a position where its bottom edge abuts the top edge of the knob 108. In this position, the tab 60 prevents removal of the shoulder 106 from the ridge 110.

After both of the openings 102 on the handle 100 are installed on the two knobs 108, the U-shaped configuration of the handle 100 maintains the tabs 104 on top of the knobs 108, preventing their release.

As can be understood, to install the opening 102 for each side of the handle 100 onto the respective knob 108, the lower parts of the handle may need to be bent during attachment in order to put the various parts in their appropriate positions. One side may be installed by tilting the handle 100, and then the other by bending the lower portion of the handle. Alternatively, both sides may be bent and installed at the same time. The opposite bending operation may be used to remove the handle 100, for example to replace a damaged handle with a new handle.

The handle 100 of the present invention may be installed by a laborer without tools and by quick operation of two hands. The laborer may grasp the lower portion of both sides of the handle 100 and bend the portions inward and install as described above. Alternatively, the laborer may tilt the handle to install one side and then bend the handle at the other side to properly align the opening 102 with the knob 108.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An insulated container, comprising:

a body;

a lid hingedly attached to said body;

one or more sockets positioned in one of the body or the lid; and one or more connecting devices equal in number to the sockets, connecting the lid to the body, each connecting device comprising:

a hinge portion;

a first connector for connecting to the other of the body and the lid; and a second connector comprising a barb configured upon rotation to engage and anchor into one of the sockets;

wherein each barb comprises teeth such that the barb may be inserted into a respective socket, and rotating the barb causes the teeth to engage the walls of the socket, trapping material behind the barb, and causing the barb to become anchored in the socket.

2. The insulated container of claim 1, wherein the socket is oblong in cross section, and the teeth are configured to enter the socket without significantly engaging walls of the socket, and to engage and anchor into the walls of the socket upon rotation.

3. The insulated container of claim 1, wherein each barb comprises a protrusion, and each socket comprises a shelf, and wherein the protrusion is configured to nest with the shelf of the socket so as to maintain alignment of the barb and the socket when the barb is rotated relative to the socket, and wherein the teeth are configured to displace material of a wall of the socket upon rotating the barb.

4. The insulated container of claim 1, wherein the connecting device is formed as a single, unitary piece.

* * * * *